United States Patent [19]

Levasseur et al.

[11] 4,151,904

[45] May 1, 1979

[54] COIN DETECTION DEVICE

[75] Inventors: Joseph L. Levasseur; William A. Seiter, both of St. Louis, Mo.

[73] Assignee: H. R. Electronics Company, High Ridge, Mo.

[21] Appl. No.: 850,943

[22] Filed: Nov. 14, 1977

[51] Int. Cl.[2] ..... G07F 3/02

[52] U.S. Cl. ..... 194/100 A; 194/97 R; 73/163

[58] Field of Search ..... 194/97 R, 100 R, 100 A, 194/1 N, 1 M; 73/163

[56] References Cited

U.S. PATENT DOCUMENTS

| | | | |
|---|---|---|---|
| 2,317,351 | 4/1943 | Andalikiewicz et al. | 194/100 R |
| 2,327,945 | 8/1943 | Wallin | 194/100 A |
| 3,739,895 | 6/1973 | Fougere et al. | 194/100 A |
| 3,869,663 | 3/1975 | Tschierse | 194/100 A X |
| 3,918,564 | 11/1975 | Heiman et al. | 194/100 A |

FOREIGN PATENT DOCUMENTS

| | | | |
|---|---|---|---|
| 2315963 | 10/1974 | Fed. Rep. of Germany | 73/163 |

*Primary Examiner*—Joseph J. Rolla

*Attorney, Agent, or Firm*—Charles B. Haverstock

[57] ABSTRACT

An apparatus for detecting objects such as coins and the like and for generating signal responses that depend on the metal content or other characteristics of the object or coin, which apparatus includes a detector circuit including an oscillator device having a coil portion for producing a frequency change due to the presence of an object or coin in the field thereof, said detector circuit producing output responses to represent the presence of objects or coins having certain preselected characteristics, and other control circuits including a circuit portion responsive to the output responses of said detector circuit for inhibiting the operation of such control circuits. The present device may also include a coin handling apparatus which prevents return to a customer of an object or coin that has characteristics that are not acceptable for vending, change making, or other functions.

13 Claims, 3 Drawing Figures

COIN DETECTION DEVICE

Many metallic detector devices including detector devices for detecting the characteristics of coins or other metallic objects have been devised and used in the past. Typical of such devices are the devices disclosed in U.S. Pat. Nos. 3,918,564 and 3,918,565. Such devices have been used in coin units of vending and related type devices and have included means for discriminating between valid and invalid or counterfeit coins. In the past, many of the known devices have generally been relatively inaccurate and have, for the most part, been unable and/or unsuitable for discriminating between genuine coins and certain types of bad coins, including bad coins or slugs made of materials or combinations of materials that are very similar to the materials used in genuine coins. This problem is aggravated by the fact that there are now many genuine coins made out of substances which are relatively inexpensive and plentiful and therefore can be copied or duplicated fairly inexpensively, easily and accurately. The problem is further aggravated by the many different kinds and sizes of coins in use throughout the world today. Because of this it is increasingly more necessary to provide even more accurate and sensitive means for discriminating between the valid and invalid or counterfeit coins. Furthermore, because of the wide use of slugs and other invalid coins, many of which are manufactured and sold for the purpose of cheating vending machines, it is desirable, if not essential, to be able to identify these bad coins when they are used and prevent them from affecting a vending or refunding operation. It is also desirable to be able to prevent the return of these bad coins to the customer especially since such coins could, if returned, thereafter be used again in other machines where they might work. The present apparatus is designed to solve these and other problems of coin detection and coin discrimination and to make possible much more precise distinctions between valid and invalid coins, and to do so before the coin has moved to a position in a vending machine where it can operate means which cause entries to be made that initiate vending, refunding and other operations in the vending machines. To this end the present detector means are located upstream or ahead of the means in a coin unit which produce the signals or entries which cause the various vending machine functions to take place, and the subject means not only are able to discriminate between valid and invalid or counterfeit coins but they do so in time to be able to produce outputs prior to the time that the coin moves against the coin switch or other operator means in the coin unit. This means that even though a slug or other bad coin is able to operate the coin switch means, by the time it does so other circuit means will have been established to inhibit or prevent the operation thereof from having any affect on the operation of the vending machine. This is accomplished by inhibiting the entry circuits in some way.

It is therefore a principal object of the present invention to provide more accurate means for distinguishing between valid and invalid or counterfeit coins and slugs.

Another object is to prevent the return of a coin to a customer once it is determined that the coin is not genuine.

Another object is to reduce losses in vending machines.

Another object is to devise a coin detector device which includes means for generating output signals, the frequency of which vary with the metallic content and other characteristics of the coin.

Another object is to provide detector means which include means for counting the cycles of an oscillator circuit that has a coil portion through which or adjacent to which a coin or other metal object moves.

Another object is to count the operating cycles of an oscillator circuit during equal length time intervals, including intervals when a coin moves in the field of the oscillator circuit and produces a change in the oscillator frequency, and to make use of the cycle count during each time interval to determine whether a coin is a genuine coin or not.

Another object is to make a determination as to whether a coin is a valid or an invalid coin as the coin moves in a coin unit of a vending or like machine and before the coin is able to operate switches or other devices that cause entries or other actions to take place, and to prevent such entries or actuations from having any affect when it is determined that a coin is not genuine or acceptable.

Another object is to teach the construction of means for establishing equal duration time intervals during which the cycles of an oscillator circuit are counted.

Another object is to remove counterfeit coins and slugs from circulation.

Another object is to make it unprofitable to market counterfeit or non-genuine coins and slugs.

These and other objects and advantages of the present invention will become apparent after considering the following detailed specification which covers several preferred embodiments of the device in conjunction with the accompanying drawing, wherein.

Figure 1:
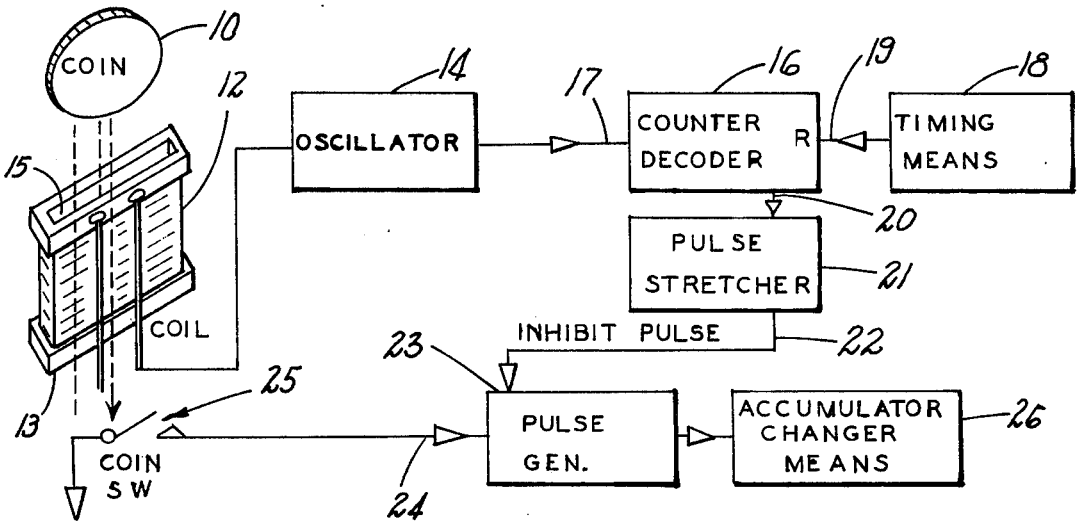
FIG. 1 is a block diagram of a coin detection circuit constructed according to the teachings of the present invention.

Referring to the drawing more particularly by reference numbers, number 10 refers to a coin which is inserted into a coin unit of a vending or like machine. In the usual situation, the coil will pass through a slug rejector device and will either be rejected by the device and returned to the customer without having any other affect on the machine, or it will pass down the chute reserved for acceptable coins and will operate switches or other sensing devices which will cause entries to be made which will in turn cause the vending machine to produce a vend, a refund, an escrow or some other change-making operation or combination thereof. The present circuit includes means for making a determination as to whether the deposited coin is a valid and therefore acceptable coin or whether it is an invalid and therefore unacceptable coin. A coin can be unacceptable for various reasons, including being a counterfeit coin or a slug. It is important to the present device that this determination is made as the coin moves through the coin unit of a vending or like machine and preferably before it is in a position to operate the means that make entries into the machine. Thereafter, the coin, whether acceptable or not, will move down the chute reserved for valid coins and will fall into the cash box or other coin storage unit (not shown).

With the subject device, when the coin 10 is inserted into the coin unit it passes along a chute which is positioned adjacent to or extends through the coils or windings of a detector coil 12. The coil 12 may be mounted on a suitably shaped tube 13 of some electrically inert substance such as plastic. The tube 13, as shown, is rectangular in cross section, and the passage 15 therethrough is of a size and shape to allow the coin to easily pass through. It is usually preferred that the detector coil 12 circumscribe or extend around the coin passage although it is possible and contemplated that the coin could also pass adjacent thereto so long as it is able to produce a detectable change in the field of the coil 12.

The coil 12 is connected as part of an oscillator circuit 14 which may be of a conventional construction, such as being a Colpits of Hartley oscillator circuit, and during passage of the coin 10 through the coil 12 the inductance of the coil 12 will change to some extent depending upon the metallic content and the physical characteristics of coin 10. The change in inductance will produce a change in the oscillation frequency of the oscillator circuit 14 usually increasing the oscillation frequency. The oscillator circuit 14 is connected to a counter-decoder circuit 16 which includes means that count the cycles of the oscillator circuit 14 during equal duration time periods. The equal duration time periods are established under control of timing circuit 18 which will be described later. At this point it is sufficient to recognize that the timing circuit establishes equal duration time periods, with the end of one time period being the beginning of the succeeding time period. In the disclosed embodiments the timing means 18 which control the counting period of the counter-decoder circuit 16 operate to reset the circuit 16 at the end of each time period so that the count in the counter-decoder 16 will start from zero, or from some other reset condition, at equal spaced intervals. This means that for each equal duration time period the counter-decoder 16 will count the number of oscillator cycles occurring during that time period and that the final count realized by the counter-decoder 16 during that period will depend on the frequency of the oscillator 14 during that time period. The counter-decoder 16 may assume a variety of forms, and circuits for counting the number of cycles of the output signal from an oscillator are well known in the art. For example, in one known configuration, the counter-decoder circuit 16 may convert the output signal from the oscillator into pulses with one pulse corresponding to each cycle of the oscillator output signal and use these pulses to trigger an electronic counter. It should be recognized, however, that many circuit configurations are possible, such as for example, a simple cycle counter, a charge storage or integrator circuit, a shift register, a ring counter, or an adder type circuit, or other forms as well. The counter-decoder circuit 16 has a first input 17 connected to respond to or to receive the outputs of the oscillator circuit 14 and a second or reset input 19 which is connected to the timing circuit 18.

The timing circuit 18 will produce a reset signal at the input 19 to reset the counter circuit 16 at equally spaced time intervals as aforesaid. When no coin is present in the coin unit or adjacent to the coil 12 the counter circuit 16 will count to some final value or count which is determined by the normal rest frequency of the oscillator 14 during each time period and will then reset and start counting again during the next time period. During these time periods when no coin is present the counter 16 will be unable to count to a high enough value to have any effect on the operation of the circuit. When a coin is then deposited in the coin unit and moves through the coil 12, it will affect the field of the coil 12 in such a way as to increase the oscillator frequency and the frequency increase will cause the counter-decoder 16 to count to a higher final count during those time periods when the coin is moving through the coil 12 than when no coin is moving through the coil 12. For a valid coin of known characteristics and a given oscillator 14, the higher frequency and higher final count for any given valid coin can be fairly precisely predetermined and are generally less than the frequency and final count resulting from the passage of an invalid coin or slug through the coil 12. Consequently, when an invalid coin or slug is passing through the coil 12 its characteristics cause the frequency of the oscillator circuit 14 to increase to a higher frequency than it would for a valid coin and therefore causes the counter 16 to count to a higher final count than if the coin were valid. If the count in the counter 16 passes beyond some predetermined count which represents the top limit for valid coins, the counter-decoder circuit 16 will produce an inhibit output signal on lead 20, which signal is processed in pulse stretcher circuit 21 so as to effect a longer duration inhibit output on lead 22. The inhibit signals generated on lead 22 are then applied as inhibit inputs to a credit encoding means such as pulse generator circuit 23 or a like device so as to prevent the invalid coins or slugs that are passing through the coil 12 from affecting vending, refunding or other related functions. While the preferred embodiment is described in terms of employing a pulse generator it will be recognized that various other credit encoding means could also be employed equally well, such as, for example, a programmed logic array or encoding matrix or other like device.

In addition to the inhibit inputs on lead 22 the pulse generator 23 also receives other coin drop inputs on lead 24, which lead is connected to coin switch 25. The coin switch 25 is positioned in the coin chute at a location to respond to coins after they have passed through the coil 12 and to generate a coin drop signal on lead 24 in response thereto as a consequence of switch 25 actuation. The inhibit pulses generated on the lead 22 are sufficiently long in duration to extend to the time when the invalid coin actuates the coin switch 25 and effects a coin drop signal on lead 24. The presence of an inhibit signal on lead 22 at the time that a coin drop signal input is detected on lead 24 prevents the pulse generator 23 from being enabled by the actuation of the coin switch 25 by that invalid coin. This means that actuation of the coin switch 25 by an invalid or counterfeit coin is made ineffectual insofar as being able to have any affect on the operation of the vending machine. For example, the inhibit pulses operate to prevent signals indicating receipt and acceptance of the coin for vending from being fed from the pulse generator 23 to accumulator-changer circuit 26. By preventing such signal entries from being made into the circuit 26 to effect a vend, make change, or perform other functions the inhibit pulses effectively negate any recognition of or acceptance of the invalid coin for purposes of affecting vending functions. The importance of being able to inhibit entries from being made into the accumulator 26 by the deposit of non-genuine coins or slugs is highly desired because the accumulator 26 is the principal element or circuit that causes vending, refunding, escrowing and other functions of the vending machine to take place.

The subject coin detection device allows all coins, both good and bad, except possibly those that are rejected for physical reasons, to move through the coin unit, to actuate the coin switch 25, and to enter into the coin box. This prevents return of the bad coins to the customer and takes them out of circulation without any loss to the vending machine owner.

When a genuine coin is deposited the frequency of the oscillator increases but not sufficiently to cause the count in the counter 16 to pass beyond the predetermined upper limit count of the counter 16, and no output signal is therefore produced by the counter-decoder circuit 16 on the lead 20. Consequently, there is in this case no pulse output on lead 20 for the pulse stretcher circuit 21 to stretch and no output will be produced on the lead 22. This means that when a valid coin passes through the coil 12 and thereafter actuates the coin switch 25 it will cause a signal to be fed to the pulse generator circuit 23 to actuate the pulse generator so that it will make an appropriate entry in the accumulator-changer circuit 26. The valid coin may then pass into the coin box or it might be sidetracked and fed to a coin tube for later use in making change, or refunding. If the vending machine is unable to make the desired vend after one or more valid coins are deposited or if the deposit in valid coins is not enough to equal the vend price the customer would not have lost any money because he would receive a proper refund from the change making mechanism in the usual way.

Figure 2:
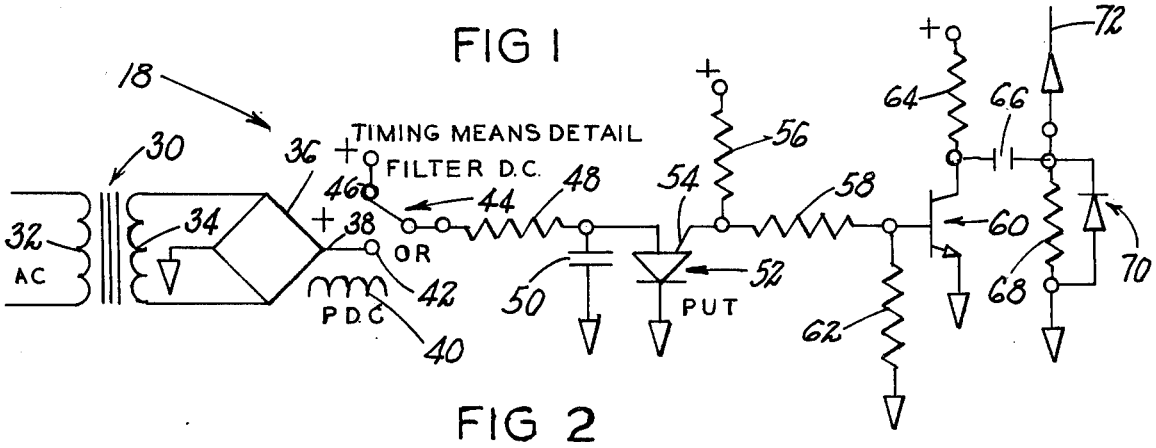
FIG. 2 is a circuit diagram of the timing circuit portion of the detection circuit shown in FIG. 1; and, FIG. 3 is a modified form of the circuit shown in FIG. 1.

FIG. 2 shows the circuit for a preferred embodiment of timing means 18 for use with the subject device. The timing device 18, as explained above, has a connection to the reset input 19 of the counter-decoder circuit 16, and in the embodiment shown is used to reset the circuit 16 at equally spaced time intervals as aforesaid. The timing means include an input transformer 30 which has a primary winding 32 connected to an AC source and a secondary winding 34 connected across the input of full wave rectifier circuit 36. One side of the rectifier output is grounded and the opposite side is connected by lead 38, which is positioned adjacent to a winding 40 of a pulsating DC source, to stationary contact 42 of a switch 44. The switch 44 has a secondary stationary input contact 46 connected to a positive voltage source, and the output of the switch 44 is connected to one side of resistor 48, the opposite side of which is connected to one side of grounded capacitor 50 and to the base terminal of programmable unijunction transistor 52. The transistor 52 turns on and off in accordance with the RC timing network 48, 50 which is connected to a regulated voltage source through contact 46. If the values of resistor 48 and capacitor 50 are chosen to provide a time constant longer than the power line frequency (half wave to trigger) the timing means provided will be as accurate as the frequency period of the power source.

The control electrode 54 of the programmable unijunction transistor 52 is connected to a circuit portion that includes a first resistor 56 connected to a positive voltage source and a second resistor 58 which is connected to the base element of transistor 60 and to grounded resistor 62. The emitter of the transistor 60 is grounded and the collector is connected through resistor 64 to a positive voltage source and through capacitor 66 to a circuit portion which includes grounded resistor 68 connected in parallel with diode 70. This circuit portion produces output pulses on lead 72 at spaced time intervals depending upon the RC time constant of the circuit. The lead 72 in FIG. 2 corresponds to the lead 19 of the circuit in FIG. 1 and is connected to the reset terminal of the counterdecoder circuit 16 so that every time a signal is present on the lead 19 the counter 16 will be reset. During operation this occurs at equally spaced time intervals depending on the RC time constant as aforesaid. The timing circuit 18 operates by having the switch 44 in one of its two operating positions. In one position of the switch 44, the circuit receives filtered DC by way of the contact terminal 46, and this establishes a positive voltage on the capacitor 50 which builds up until the programmable unijunction transistor 52 starts to conduct. When this occurs the potential on the control electrode 54 goes from a positive voltage condition, in which condition the transistor 60 is conducting, to a ground or near ground condition, in which condition the transistor 60 becomes non-conducting. When transistor 60 goes from a conducting to a non-conducting condition the collector of the transistor 60 goes from a ground or near ground condition to a positive voltage condition and this positive voltage is applied through the high pass RC circuit comprised of capacitor 66 and resistor 68 to produce a reset signal on the output lead 72 (19) to reset the counter-decoder 16. Consequently, it may be seen that a reset signal is produced on lead 72 (19) when the capacitor 50 is charged sufficiently to cause unijunction transister 52 to being conducting and that the charging time for the capacitor 50 is dependent upon the time constant of the RC circuit 48, 50. When the unijunction transistor 52 begins conducting capacitor 50 discharges and the voltage on the base terminal of the unijunction transistor 52 drops causing the unijunction transistor 52 to stop conducting and the transistor 60 to therefore begin conducting until sufficient voltage has again built up on capacitor 50 as previously explained. In this manner the unijunction transistor cycles between its conducting and nonconducting states causing reset pulses to be generated on lead 72 (19) at spaced time intervals under control of the cycling of the unijunction transistor 52. The operation will be substantially the same if the switch 44 is in position making contact with the terminal 42, but in this case the positive input potential which is applied will be applied from the full wave rectifier 36 instead of from the filtered DC terminal 46.

Figure 3:
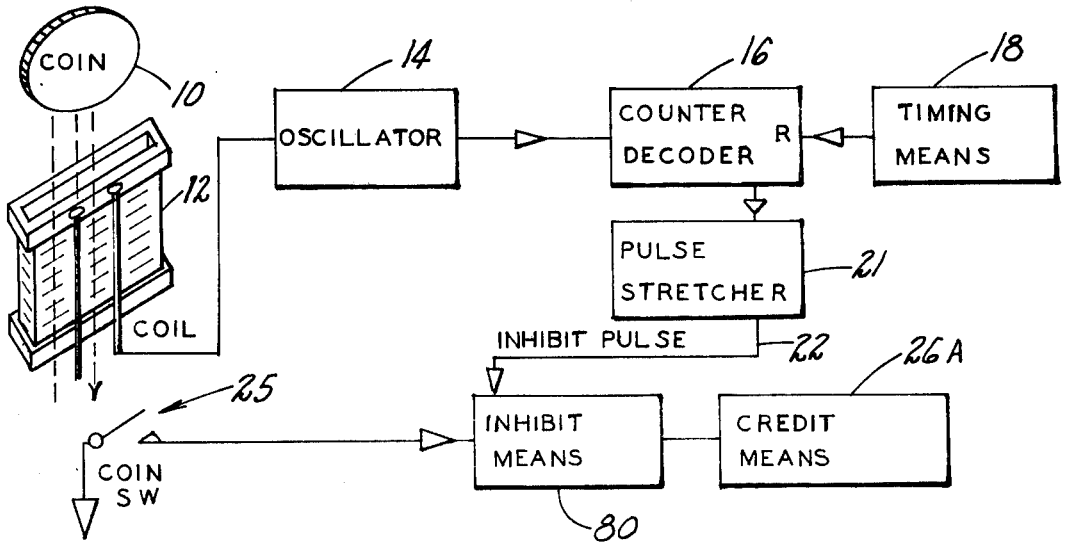

FIG. 3 discloses another embodiment of the subject circuit which is similar to the embodiment shown in FIG. 1 insofar as the elements 12, 14, 16, 18, and 21 are concerned. However, in the circuit of FIG. 3 the inhibit pulses produced on lead 22 in the output of the pulse stretcher 21 are applied to inhibit means 80 connected between the output side of the grounded coin switch 25 and the credit entry means 26A. The credit means 26A may be similar to the accumulator-changer means 26 of FIG. 1, of which there are many possible embodiments. The fact that the circuit of FIG. 3 inhibits entries from being made into the credit means 26A, rather than inhibiting the operation of the pulse generator such as the pulse generator 23, is the main difference between the circuits of FIGS. 1 and 3.

Either of these constructions can use various forms of accumulators or credit entry means including accumulators and credit entry means such as, for example, those disclosed in U.S. Pat. Nos. 3,820,642; 3,841,456; 3,894,220; 4,008,792 and 4,034,839. It will be appreciated that a pulse generator means need not be employed in all applications of the subject invention, as, for instance, when the invention is used in conjunction with the invention of U.S. Pat. No. 3,307,671, and that many means exist and can be employed for inhibiting entry of coin drop information into the credit means 26A from the coin switch 25. The particular inhibit means employed will necessarily depend upon the particular credit means with which it is to be used. It is also apparent that the present application has broad application as a means for controlling the entering of information into credit means of some type.

The present device is sometimes referred to in the trade as a slug eater device because it removes from circulation those coins which are invalid for some reason and does not return them to the customer for later use. To this end it is important to be able to distinguish between those slugs that have characterisitcs that are very similar to the characteristics of genuine coins. Such slugs are sometimes marketed illegally, and unless they are removed from circulation, they can be tried in other vending machines where they might work. The present device makes it uneconomical for the manufacturers and sellers of such slugs and other invalid coins to market their products.

Thus there has been shown and described a coincontrolled circuit with novel means for controlling what information will be entered into a credit storage means or accumulator based on whether a deposited coin is valid or invalid. Many changes, modifications, variations and other uses and applications for the subject control circuit will become apparent to those skilled in the art after considering this specification which discloses several embodiments thereof. All such changes, modifications, variations and other uses and applications which do not depart from the spirit and scope of the invention are deemed to be covered by the invention which is limited only by the claims which follow.

What is claimed is:

1. In a vending control circuit having a coin unit including a coin chute into which coins are deposited, means actuatable by a deposited coin for producing a signal, credit entry means, and circuit connection means operatively connecting said actuatable means to said credit entry means, said credit entry means being responsive to the production of said signal for making an appropriate credit entry for each coin deposited, the improvement comprising an oscillator circuit including a coil positioned adjacent to the coin chute in the coin unit and at a location upstream from the means actuatable by the coin, a counting circuit operatively connected to the oscillator circuit including means for counting the operating cycles of the oscillator circuit, means for resetting the counter circuit to a predetermined initial condition at equal time intervals, said counter reset means including a timing circuit, means connecting the timing circuit to the reset input of the counter, said counter circuit having an output and including means for producing a signal thereat whenever the count during any one of said equal duration time intervals exceeds some predetermined count, and means responsive to output signals produced by the counter, said last named means including means to prevent operation of the actuatable means by a coin from making an entry into the credit entry means whenever the counter produces an output.

2. In the vending control circuit defined in claim 1, the means responsive to the output signals include a gate circuit connected between the coin actuated means and the credit entry means.

3. In the vending control circuit defined in claim 1 the means responsive to the output signals include a pulse generator and means to prevent the pulse generator from producing an output whenever the pulse generator receives an input from the counter.

4. In the vending control circuit defined in claim 1, a pulse stretcher circuit is connected between the output of the counter and said circuit connection between the coin actuated means and the credit entry means, said pulse stretcher circuit including means to prolong the duration of the output signals of the counter circuit for sufficient time to prevent operation of the coin actuated means by a coin from producing an entry into the credit entry means.

5. In a vending machine having a coin unit including a coin chute along which deposited coins move, said chute having switch means actuatable by each coin that moves along the chute and credit entry means having an input operatively connected to the switch means, the improvement comprising a coil mounted adjacent to the coin chute ahead of the switch means actuatable by each coin, circuit means operatively connected to said coil including means for producing a first frequency response when a valid coin is moving in the coin chute adjacent to the coil and a different frequency response when an unacceptable coin is moving in the chute adjacent to said coil, means to distinguish between the first and the different frequency responses including means to generate an output signal whenever said different frequency response is produced, and control circuit means connected between the means actuatable by each coin and the credit entry means, said control circuit means including means responsive to the production of each of said output signals to inhibit making an entry into the credit entry means when the switch means actuatable by a coin are actuated by an unacceptable coin.

6. In the vending machine defined in claim 5 the coil circumscribes the coin chute.

7. In the vending machine defined in claim 5 the control circuit means include an inhibit gate circuit.

8. In the vending machine defined in claim 5 the control circuit means include a pulse generator having an input connected to the means actuatable by a coin, an output connected to the credit entry means, and an inhibit input, and means operatively connecting said inhibit input to the means to distinguish between the first and the different frequency responses.

9. In the vending machine defined in claim 5 the control circuit means include means to prolong the duration of said output signal until after said switch means has been actuated.

10. In the vending machine defined in claim 5 said circuit means operatively connected to the coil include an oscillator circuit, and said means to distinguish between the first and the different frequency responses include means to count the cycles of the oscillator circuit and means to establish equal duration time periods during which the means to count cycles of the oscillator circuit are counted.

11. In the vending machine defined in claim 10 the means to establish equal duration time periods include an RC timing circuit.

12. In the vending machine defined in claim 10 the means to establish equal duration time periods include a timing circuit having a programmable uni-junction transistor and an associated timing circuit having a predetermined time constant.

13. In a vending control circuit having a coin unit including a coin chute into which coins are deposited, means actuatable by a deposited coin for producing a signal, and credit entry means operatively connected to said coin actuatable means for making a credit entry for each deposited coin, the improvement comprising means to interrupt communication between the means actuatable by a deposited coin and the credit entry means to prevent entry into the credit entry means by actuation of the coin actuatable means due to actuation of the coin actuatable means by certain coins and not by others, said last named means including means for producing an output signal having frequency response characteristics representative of each coin deposited in the coin chute, means for distinguishing between the frequency response characteristics of output signals produced by valid coins and the frequency response characteristics of output signals produced by invalid coins, said means for distinguishing including means for producing a response representative of the number of cycles of said output signal produced during equal duration time intervals, means for generating an inhibit signal whenever the response produced is representative of an invalid coin being deposited, entry control circuit means connected between the coin unit and the credit entry means, means connecting the means for distinguishing between responses to the entry control circuit means, said entry control circuit means including means responsive to production of a response representative of an invalid coin to prevent operation of the coin actuatable means from making an entry into the credit entry means.

* * * * *

UNITED STATES PATENT OFFICE

CERTIFICATE OF CORRECTION

Patent No. 4,151,904 Dated May 1, 1979

Inventor(s) Joseph L. Levasseur & William A. Seiter

It is certified that error appears in the above-identified patent and that said Letters Patent are hereby corrected as shown below:

Column 2, line 44 "coil" should be

--coin--

Signed and Sealed this

*Seventeenth* Day of *July 1979*

[SEAL]

*Attest:*

*Attesting Officer*

LUTRELLE F. PARKER

*Acting Commissioner of Patents and Trademarks*